US010487284B2

(12) United States Patent
Hotta et al.

(10) Patent No.: US 10,487,284 B2
(45) Date of Patent: Nov. 26, 2019

(54) SLIDING SYSTEM

(71) Applicant: KABUSHIKI KAISHA TOYOTA CHUO KENKYUSHO, Nagakute-shi, Aichi-ken (JP)

(72) Inventors: Shigeru Hotta, Nagakute (JP); Hiroyuki Mori, Nagakute (JP); Mamoru Tohyama, Nagakute (JP); Toshihide Ohmori, Nagakute (JP)

(73) Assignee: KABUSHIKI KAISHA TOYOTA CHUO KENKYUSHO, Aichi-ken (JP)

( * ) Notice: Subject to any disclaimer, the term of this patent is extended or adjusted under 35 U.S.C. 154(b) by 71 days.

(21) Appl. No.: 15/880,919

(22) Filed: Jan. 26, 2018

(65) Prior Publication Data

US 2018/0282652 A1 Oct. 4, 2018

(30) Foreign Application Priority Data

Apr. 3, 2017 (JP) ..... 2017-074043

(51) Int. Cl.
*C10M 125/22* (2006.01)
*C10M 139/00* (2006.01)
(Continued)

(52) U.S. Cl.
CPC ..... *C10M 125/22* (2013.01); *C10M 101/00* (2013.01); *C10M 169/04* (2013.01); *C10M 2201/066* (2013.01); *C10M 2203/003* (2013.01)

(58) Field of Classification Search
CPC ..... C10M 125/22; C10M 139/00; C10M 169/04; C10M 101/00; C10M 2227/09;
(Continued)

(56) References Cited

U.S. PATENT DOCUMENTS 4,725,512 A * 2/1988 Scruggs ..... B23K 35/30 148/403
5,160,537 A * 11/1992 Terrat ..... C23C 14/0688 106/36
(Continued)

FOREIGN PATENT DOCUMENTS

JP 2001-46964 A 2/2001
JP 2008-144193 A 6/2008
(Continued)

OTHER PUBLICATIONS

Internal Partial Translation (Irina Knizhnik Aug. 14, 2019) (Year: 2019).*
(Continued)

*Primary Examiner* — Pamela H Weiss
(74) *Attorney, Agent, or Firm* — Oliff PLC

(57) ABSTRACT

A sliding system includes a pair of sliding members having sliding surfaces that can relatively move while facing each other and a lubricant oil interposed between the sliding surfaces facing each other. At least one of the sliding surfaces includes a coating surface of a crystalline Cr plating film. The lubricant oil contains an oil-soluble molybdenum compound comprising a trinuclear Mo structure. In particular, considerably low friction properties can be developed by a combination of the Cr plating film, in which at least one of three types of peak area intensity ratios (P1 to P3) as obtained by X-ray diffraction falls within a predetermined range (P1≥0.015, P2≥0.02, P3≥0.03), and the lubrication oil which contains the trinuclear Mo structure.

3 Claims, 5 Drawing Sheets

(51) Int. Cl.
*C10M 169/04* (2006.01)
*C10M 101/00* (2006.01)

(58) Field of Classification Search
CPC ..... C10M 2201/066; C10M 2203/003; C10N 2240/10; C10N 2230/06; C10N 2210/06
See application file for complete search history.

(56) References Cited

U.S. PATENT DOCUMENTS 5,861,659 A * 1/1999 Okabe ..... H01L 29/1004 257/518
5,871,852 A * 2/1999 Toyoda ..... C25D 3/562 148/320
6,355,366 B1 * 3/2002 Santini ..... C25D 3/04 205/194
7,291,384 B2 * 11/2007 Obara ..... C23C 4/06 427/455
7,422,797 B2 * 9/2008 Tanita ..... C25D 3/10 428/613
7,553,381 B2 * 6/2009 Ishizaki ..... C23C 14/02 148/422
9,493,871 B2 * 11/2016 Tanaka ..... C23C 14/24
9,790,447 B2 * 10/2017 Mori ..... C10M 113/08
10,006,546 B2 * 6/2018 Sato ..... F16J 9/26
10,006,547 B2 * 6/2018 Sato ..... F16J 9/26
10,301,568 B2 * 5/2019 Mori ..... C10M 125/22
2008/0038147 A1 * 2/2008 Ishizaki ..... C23C 14/02 420/427
2015/0292078 A1 * 10/2015 Tanaka ..... C23C 14/0641 428/216
2016/0115414 A1 4/2016 Mori et al.
2017/0248625 A1 * 8/2017 Kaeppeli ..... B65G 54/02
2017/0369811 A1 12/2017 Kasai

FOREIGN PATENT DOCUMENTS

JP 2016-017174 A 2/2016
JP 2016-084852 A 5/2016
WO 2016/114401 A1 7/2016

OTHER PUBLICATIONS

Feb. 19, 2019 Office Action issued in Japanese Patent Application No. 2017-074043.
Jul. 16, 2019 Office Action issued in Japanese Patent Application No. 2017-074043.

* cited by examiner

R = hydrocarbyl

Mo−Trinuclear

SLIDING SYSTEM

TECHNICAL FIELD

The present invention relates to a sliding system which can achieve the drastically reduced friction by means of a combination of a chromium plating film and a lubricant oil that contains an oil-soluble molybdenum compound having a specific chemical structure.

BACKGROUND ART

Various machines are provided with sliding members that relatively move while being slidably in contact with each other. In a system having such sliding members (referred to as a "sliding system" in the present description, e.g. a sliding machine), the friction coefficient between the sliding surfaces may be reduced thereby to reduce the sliding resistance and it is possible to enhance the performance and reduce the operational energy. Moreover, the reduced friction can also contribute to improvement in the durability, reliability and other necessary properties of the sliding system.

Sliding properties (in particular, the friction coefficient) are different depending on the surface condition of each sliding surface during the operation and the lubrication state between the sliding surfaces. In order to enhance the sliding properties, various studies have heretofore been made to modify the sliding surfaces and improve the lubricant (lubricant oil) which is supplied between the sliding surfaces. Descriptions relevant to the above studies are found, for example, in Patent Literature below.

PRIOR ART LITERATURE

Patent Literature

[Patent Literature 1] JP2016-17174A
[Patent Literature 1] JP2008-144193A

SUMMARY OF INVENTION

Problems to be Solved by the Invention

Patent Literature 1 proposes a sliding machine which may significantly reduce the friction by a combination of a Cr-DLC film that covers the sliding surface and a lubricant oil that contains a Mo-trinuclear.

Patent Literature 2 discloses that the speed dependency of a desired friction coefficient may be obtained by a combination of a CrMo plating film that is crystalline in a (222)-orientated form (paragraph [0041]) and an ordinary engine oil (paragraph [0048]). According to the research studies made by the present inventors, however, the Cr plating film as proposed in Patent Literature 2 is not to reduce the friction coefficient.

The present invention has been created in view of such circumstances and an object of the present invention is to provide a sliding system that can considerably reduce the friction by means of a novel combination of an unprecedented specific sliding film and a lubricant oil.

Means for Solving the Problems

As a result of intensive studies to achieve the above object, the present inventors have discovered that a novel combination of a chromium plating film and a lubricant oil that contains an oil-soluble molybdenum compound having a specific chemical structure can drastically reduce the friction coefficient between sliding surfaces.

Developing this achievement, the present inventors have accomplished the present invention, as will be described hereinafter.

«Sliding System»

(1) The sliding system according to the present invention comprises a pair of sliding members having sliding surfaces that can relatively move while facing each other and a lubricant oil interposed between the sliding surfaces facing each other. The lubricant oil contains an oil-soluble molybdenum compound that has a chemical structure of a trinuclear of Mo. At least one of the sliding surfaces comprises a coating surface of a crystalline chromium plating film. A peak area I(hkl) of a crystal plane (hkl) of the chromium plating film as obtained by X-ray diffraction satisfies at least one of expressions below:

$$P1=\{I(110)+I(211)\}/I(222)\geq 0.015;$$

$$P2=\{I(110)+I(310)\}/I(222)\geq 0.02;\text{ and}$$

$$P3=\{I(110)+I(211)+I(310)\}/I(222)\geq 0.03.$$

(2) In the sliding system of the present invention, at least one of the sliding surfaces coated with a specific chromium plating film (referred to as a "Cr plating film") of which the peak area intensity ratio (any of P1 to P3) obtained by X-ray diffraction (XRD) is within a specific range and the lubricant oil contains the oil-soluble molybdenum compound having a specific chemical structure are combined thereby to allow the friction coefficient between the sliding surfaces to be considerably reduced. For example, the friction coefficient between the sliding surfaces according to the present invention can be 0.05 or less in an embodiment and 0.04 or less in another embodiment. The Cr plating film is generally excellent in the wear resistance, and the sliding system of the present invention can therefore exhibit high durability and reliability in addition to the low friction properties.

Such a sliding system of the present invention is not limited in its use, but is suitable for machines, such as in a drive system, for example, which are operated for a long period of time under severe conditions from a boundary lubrication (friction) condition to a mixed lubrication (friction) condition. In particular, when the sliding system is used for an engine and/or a drive system unit such as transmission, the present invention can greatly contribute to reduction of fuel consumption, performance upgrade and other benefits while ensuring their reliability.

Cr plating films may ordinarily be formed by a wet process and are excellent in the deposition uniformity as compared with other films, such as DLC films, which are formed by a dry process. Thus, the Cr plating film can be relatively easily formed even on a sliding surface having a shape (such as a complex shape, large-size shape, deep-hole shape, and undercut shape) for which coating may be difficult by a dry process such as PVD and CVD.

(3) The mechanism is not necessarily sure that the combination of a specific Cr plating film and a specific lubricant oil develops excellent low friction properties, but it can be considered under present circumstances as follows. When the sliding system (specifically, a sliding machine) of the present invention is operated, the oil-soluble molybdenum compound, which is contained in the lubricant oil and composed of a trinuclear of Mo (and which may be referred to as a "Mo-trinuclear compound" or simply as a "Mo-trinuclear"), adsorbs onto the sliding surface of the Cr plating film. This adsorption of the Mo-trinuclear to the Cr plating film can occur even when the content of the Mo-trinuclear in the lubricant oil is very small.

It can be considered that a molybdenum sulfide compound of a layered structure similar to $MoS_2$ is generated on the Cr plating film to which the Mo-trinuclear adsorbs and this allows an excellent low shear property to be developed. It can also be considered that the adsorption of Mo (trinuclear) to the sliding surface suppresses adsorption of Ca, Zn, and other similar elements (or a Ca-based compound, Zn-based compound, and other similar compounds), which are generally contained in a lubricant oil to a certain degree and can interfere with the reduced friction, to the sliding surface. It is thus estimated that such effects synergistically act so that the sliding system of the present invention can develop the considerably low friction properties owing to the combination of the specific Cr plating film and the lubricant oil which contains Mo-trinuclear.

The Mo source for generating the molybdenum sulfide compound and other similar compounds on the sliding surface may be the Mo-trinuclear and may also be other additives or the like which have a competitive adsorption relationship with the Mo-trinuclear. The Ca source is, for example, a metal-based cleaning agent (e.g. overbased Ca sulfonate) or the like that can be contained in a lubricating oil and the Zn source is, for example, an antiwear agent (e.g. ZnDTP: Zinc Dialkyldithiophosphate) or the like.

«Others»

(1) The Mo-trinuclear according to the present invention is not limited in its functional groups bonded to the ends, molecular weight and other properties, but may preferably have a molecular structural skeleton of at least one of $Mo_3S_7$ or $Mo_3S_8$ (in particular $Mo_3S_7$). For reference, FIG. 5 illustrates an example of the molybdenum sulfide compound of $Mo_3S_7$. In the figure, R represents a hydrocarbyl group.

The Mo-trinuclear according to the present invention may react to adsorb to the sliding surface, thereby forming a molybdenum sulfide compound having a certain chemical structure, such as $Mo_3S_7$, $Mo_3S_8$ and $Mo_2S_6$ in addition to the above-described $MoS_2$, on the sliding surface. Such a molybdenum sulfide compound can also exhibit a low shear property between the sliding surfaces based on the layered structure to contribute to the reduction of the friction coefficient.

(2) The Cr plating film according to the present invention may contain elements other than Cr (e.g. doped elements such as O, H, and N) which do not interfere with the low friction properties or which improve the low friction properties. The total content of such modifying elements is preferably about 0.1-5% in an embodiment and about 0.1-2% in another embodiment. The film composition as referred to in the present description is specified using an electron probe microanalyzer (EPMA).

(3) It suffices that the "sliding system" as referred to in the present invention comprises sliding members that have one or more sliding surfaces coated with specific Cr plating films and a lubricant oil that contains a Mo-trinuclear. The sliding system of the present invention is not limited to a completed product as a machine but may merely be a combination of mechanical elements and a lubricant oil that constitute a part of the product. The sliding system of the present invention may therefore be referred to as a sliding structure, a sliding machine (e.g. an engine, transmission), or other appropriate term.

It suffices that the coating surface of the Cr plating film according to the present invention is formed as a sliding surface of at least one of the sliding members which relatively move while facing each other. As will be understood, both the sliding surfaces facing each other may be the coating surfaces of the Cr plating films.

(4) Unless otherwise stated, a numerical range "x to y" as referred to in the present description includes the lower limit value x and the upper limit value y. Any numerical value included in various numerical values or numerical ranges described in the present description may be appropriately selected or extracted as a new lower limit value or upper limit value, and any numerical range such as "a to b" may thereby be newly provided using such a new lower limit value or upper limit value.

EMBODIMENTS FOR CARRYING OUT THE INVENTION

Figure 1:
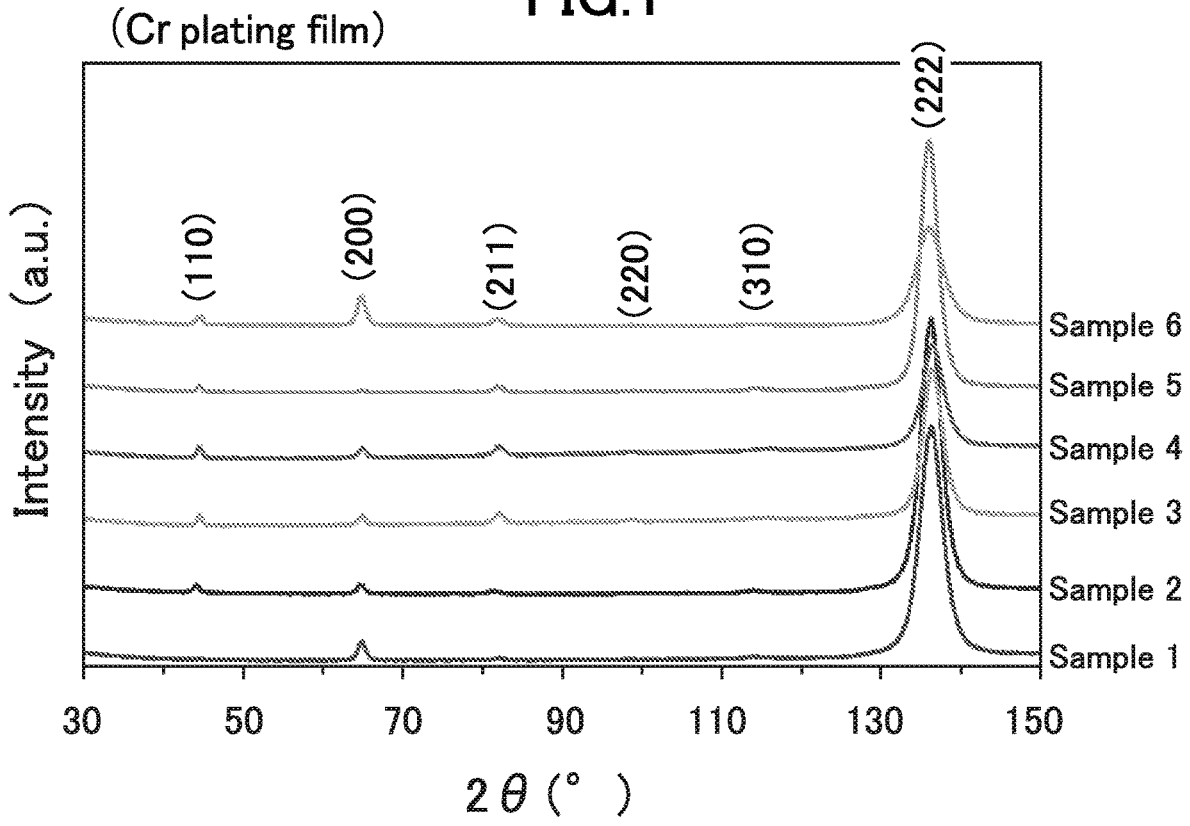
FIG. 1 is a graph for comparing XRD profiles of Cr plating films of samples.

One or more features freely selected from the present description can be added to the above-described features of the present invention. The contents described in the present description can be applied not only to the sliding system as a whole according to the present invention but also to sliding members and lubricant oil which constitute the sliding system. Features regarding a method can also be features regarding a product. Which embodiment is the best or not is different in accordance with objectives, required performance, and other factors.

«Cr Plating Film»

(1) The Cr plating film according to the present invention is crystalline and has a specific crystal structure in which at least one of the above-described peak area intensity ratios (P1 to P3) as obtained by X-ray diffraction (XRD) analysis is within a predetermined range. It suffices that at least one of P1 to P3 of the Cr plating film according to the present invention is within a desired range, but it is more preferred that two or more of P1 to P3 be within respective desired ranges.

The first peak area intensity ratio (P1) may be 0.015 or more in an embodiment, 0.018 or more in another embodiment, and 0.04 or more in still another embodiment. The second peak area intensity ratio (P2) may be 0.02 or more in an embodiment, 0.023 or more in another embodiment, and 0.025 or more in still another embodiment. The third peak area intensity ratio (P3) may be 0.03 or more in an embodiment, 0.037 or more in another embodiment, and 0.05 or more in still another embodiment. In a Cr plating film in which all the peak area intensity ratios (also referred to as "area ratios" in a simple term) are unduly small, the reduction in friction coefficient is insufficient under a lubricant oil that contains Mo-trinuclear. The upper limit of each area ratio is not limited, but the strongest peak area I(222) is considerably large, so suffice it to say that the upper limit may be 0.3 in an embodiment, 0.2 in another embodiment, and 0.1 in still another embodiment.

Combinations other than the above can also be considered as crystal planes for selecting the area ratio. For example, I(110)/I(222) and I(211)/I(222) also appear to have a correlation similar to the area ratios P1 to P3 with regard to the change in friction coefficient. According to the research studies made by the present inventors, however, it has been revealed that the area ratios P1 to P3 selected in the present invention exhibit the most definite correlation with the friction coefficient and the dispersion among respective data is the smallest. In addition, no clear correlation has been found between I(200)/I(222) and I(310)/I(222) and the friction coefficient.

(2) The Cr plating film according to the present invention may be formed using a dry process such as PVD and CVD, but may be particularly preferably formed using a wet process. The plating bath to be used in the wet process can be a Sargent bath that contains chromic acid and sulfuric acid as main components, a fluoride bath that contains chromic acid and hydrofluosilicic acid as main components, or other appropriate bath. The Sargent bath preferably contains, for example, 100-400 g/L of chromic anhydride and 1-4 g/L of sulfuric acid. The fluoride bath preferably contains, for example, 230-250 g/L of chromic anhydride, 0.7-1.5 g/L of sulfuric acid, and 2-5 g/L of hydrofluosilicic acid. The (electric) plating bath may contain an activator such as organic sulfonic acid. The plating conditions are preferably, for example, a bath temperature of 40-60° C. and a current density of 15-60 A/dm$^2$. The thickness of the Cr plating film is preferably 3-30 μm in an embodiment and 5-15 μm in another embodiment. The hardness Hv of the Cr plating film is preferably 500 to 11,000 in an embodiment and 600 to 900 in another embodiment.

«Lubricant Oil»

The lubricant oil according to the present invention is not limited in the type of a base oil and may further contain additives other than the Mo-trinuclear, provided that the lubricant oil contains the Mo-trinuclear and the other additives do not interfere with the reduced friction. In general, lubricant oil such as engine oil contains various additives including S, P, Zn, Ca, Mg, Na, Ba, Cu, etc. It can be considered that, even in such lubricant oil, the Mo-trinuclear according to the present invention preferentially acts on the sliding surface (coating surface) coated with the Cr plating film and generates a molybdenum sulfide compound (e.g. $MoS_2$, $Mo_3S_7$, $Mo_3S_8$, $Mo_2S_6$) which can reduce the friction coefficient, thereby contributing to the reduced friction. The lubricant oil according to the present invention may contain other Mo-based compounds (such as MoDTC) than the Mo-trinuclear, but the total amount of the contained Mo may preferably be small because Mo is a kind of rare metal.

While an unduly large amount of the Mo-trinuclear may not cause any problem, a very small amount of the Mo-trinuclear may be enough for reducing the friction. For example, the mass ratio of Mo to the total lubricant oil is preferably 25-900 ppm in an embodiment, 50-800 ppm in another embodiment, 60-500 ppm in still another embodiment, and 70-200 ppm in a further embodiment. When the mass ratio of Mo to the total lubricant oil is represented in ppm, it will be denoted by "ppmMo." When the lubricant oil contains Mo-based compounds and the like other than the Mo-trinuclear, the upper limit of the total amount of Mo is preferably 1,000 ppmMo in an embodiment and 400 ppmMo in another embodiment to the total lubricant oil.

«Use Application»

The present invention is not limited in the use and the like. Examples of the sliding system include engine units and drive system units (such as transmission) for vehicles such as cars. Examples of the sliding members that constitute the sliding system include components, such as a cam, valve lifter (e.g., the sliding surface is a contacting surface with a cam), follower, shim, valve and valve guide, which constitute a dynamic valve system; piston (e.g., the sliding surface is a piston skirt); piston ring; piston pin; crankshaft; gear; rotor; rotor housing; valve; valve guide; and pump.

EXAMPLES

Surfaces of base materials were coated with Cr plating films to produce a plurality of samples. The friction coefficient when each Cr plating film was used as the sliding surface was measured under lubricant oil. The present invention will be more specifically described in reference to such examples.

«Test Piece»

(1) Base Material

A plurality of block-like base materials (6.3 mm×15.7 mm×10.1 mm) was prepared, each comprising stainless steel (JIS SUS440C). The mirror-finished surface of each base material (surface roughness: Ra 0.08 μm) was used for the coating surface.

(2) Film Formation

A Cr plating film was formed by wet electroplating to provide the coating surface of each base material. A Sargent bath containing chromic acid and sulfuric acid as main components was used as the plating bath. This Sargent bath contains about 250 g/L of chromic anhydride and about 2.5 g/L of sulfuric acid.

The plating process was carried out at a bath temperature of about 50° C. and a current density of 15-60 A/dm$^2$. At that time, the current density was changed to form the Cr plating films having different crystal structures on the surfaces of the base materials. Test pieces were thus obtained, having the Cr plating films as the sliding surfaces (Samples 1 to 6).

All the Cr plating films were not heat-treated. The film thickness was about 5 μm and the hardness was about 850 Hv. The film thickness of each Cr plating film was obtained by measuring the dimensional change before and after the film formation using a micrometer. The composition of the Cr plating film was, for example, O: 0.4 mass %, H: 0.05 mass %, and the balance: Cr.

(3) Comparative Sample

A test piece was prepared as a comparative sample (Sample C0) by mirror-finishing the carburized surface of a steel material (JIS SCM420) (surface roughness: Ra 0.08 hardness HV 600) to provide the sliding surface.

«Lubricant Oil»

Engine oil (motor oil SN 0W-20 available from TOYOTA MOTOR CORPORATION) having a viscosity grade of 0W-20 and corresponding to ILSAC GF-5 standard was prepared as the lubricant oil to be used for a friction test. This engine oil (simply referred to as "standard oil") is free from molybdenum dithiocarbamate (MoDTC) and molybdenum dithiophosphate (MoDTP).

Mo-trinuclear denoted as "Trinuclear" in the disclosed documentation "Molybdenum Additive Technology for Engine Oil Applications" available from Infineum International Limited was added to the standard oil so that the Mo content in the oil as a whole would be 80 ppmMo equivalent. This oil will be referred to as "Mo-trinuclear-containing oil."

For reference to the standard oil, oil free from MoDTC and MoDTP but containing 130 ppmMo of a Mo-based antioxidant (referred to as a "Mo-trinuclear-free oil) was prepared.

«Measurement of Cr Plating Film»

The Cr plating film of each sample was analyzed using an X-ray diffractometer (available from Rigaku Corporation). Used X-ray was Cu-Kα line and 2θ was 30-150°. Profiles thus obtained were illustrated in FIG. 1 in an overlapping manner. On the basis of the profiles illustrated in FIG. 1, area ratios (P1 to P3) with respect to the strongest peak area I(222) were obtained, which are listed in Table 1. The peak area of each crystal plane was obtained using XRD analysis software (JADES) available from Materials Data, Inc.

«Friction Test»

Block-on-ring friction test (simply referred to as a "friction test") was carried out for a combination of each test piece and each oil to measure the friction coefficient (μ) of each sliding surface. The friction test was performed by sliding a block-like test piece of each sample (sliding surface width: 6.3 mm) and a ring-like standard test piece of a carburized steel material (AISI4620) (S-10 available from FALEX CORPORATION, hardness: HV800, surface roughness Rzjis: 1.7-2.0 μm, outer diameter φ35 mm×width 8.8 mm) on each other under the presence of each oil. The sliding surface of test piece of each sample was preliminarily polished using #2000 emery paper before the test to have surface roughness Ra of 0.01-0.04 μm.Test conditions were a test load of 133 N (Hertz contact pressure: 210 MPa), a sliding speed of 0.3 m/s, an oil temperature of 80° C. (fixed), and a test time of 30 minutes.

Figure 2A:
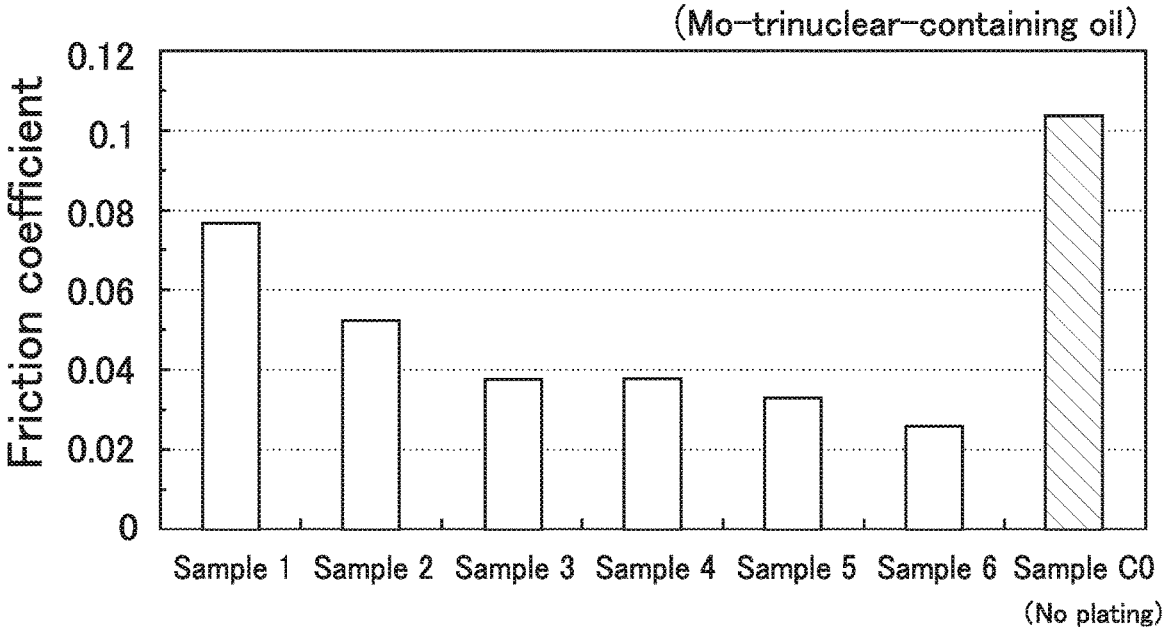
FIG. 2A is a bar graph for comparing friction coefficients of the Cr plating films.

The average value of the friction coefficient (μ) measured for one minute immediately before completion of the friction test was employed as the friction coefficient in this test. The friction coefficient thus obtained of each sample is listed in Table 1 and illustrated as a bar graph for comparison in FIG. 2A and FIG. 2B (these figures will be collectively referred to as "FIG. 2" in a simple term).

«Surface Analysis»

Figure 4A:
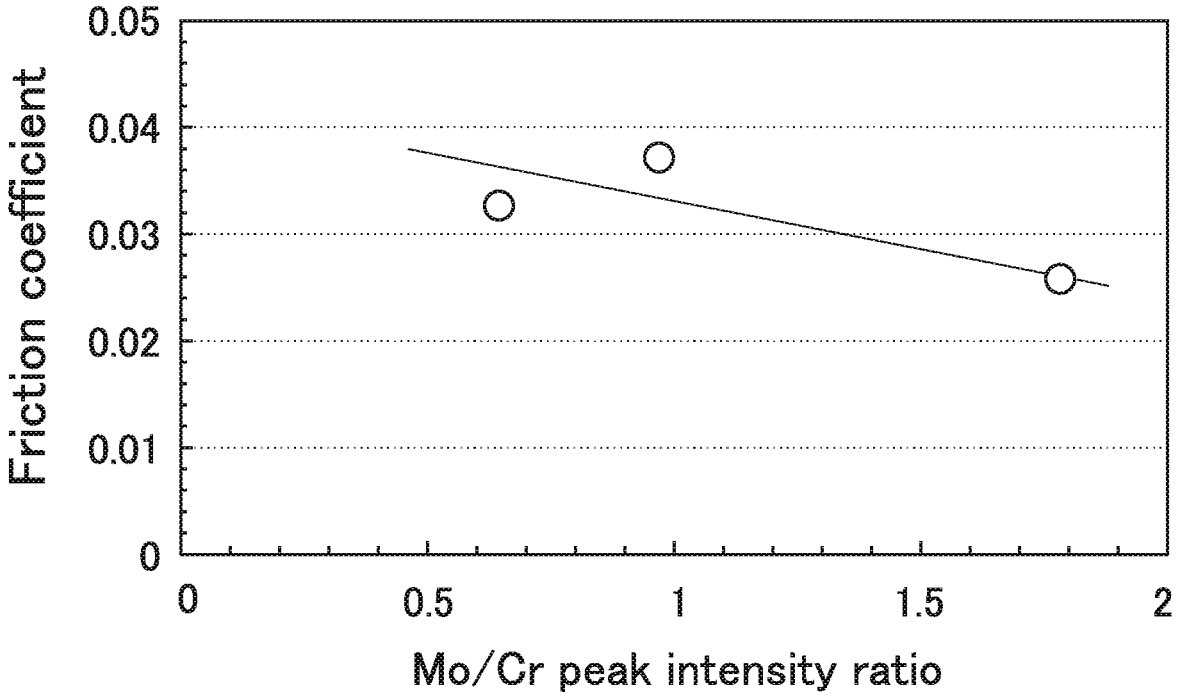
FIG. 4A is a graph illustrating the relationship between a Mo/Cr peak intensity ratio obtained using TOF-SIMS and the friction coefficient.
Figure 4B:
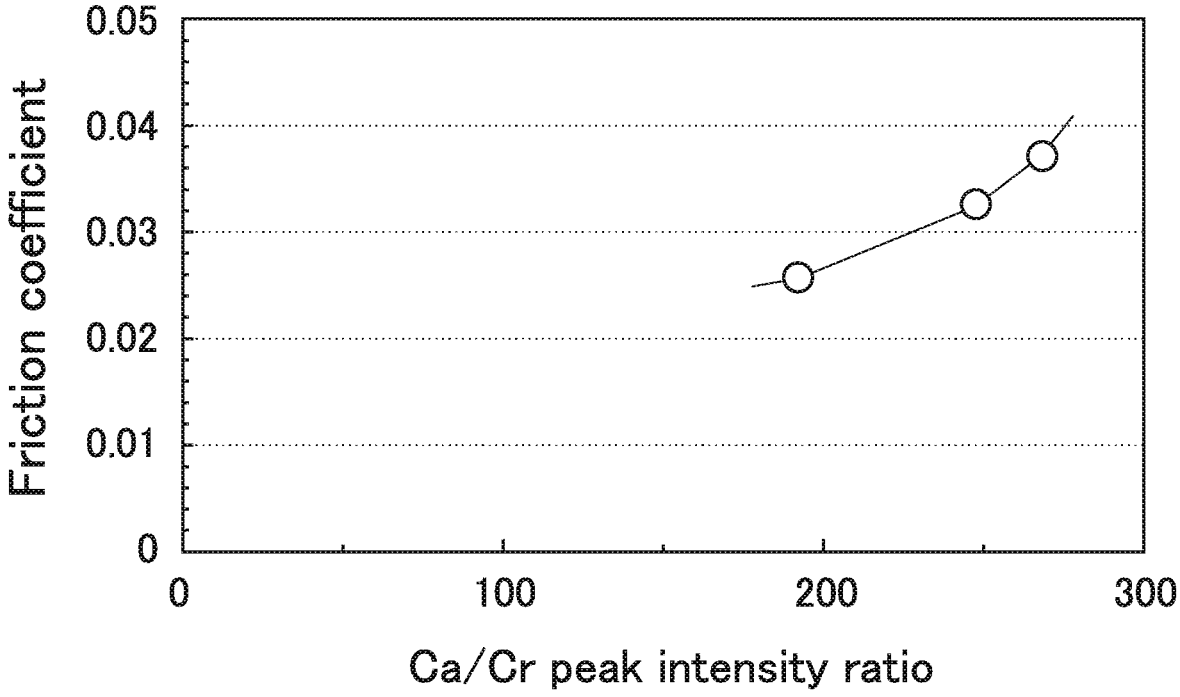
FIG. 4B is a graph illustrating the relationship between a Ca/Cr peak intensity ratio obtained using TOF-SIMS and the friction coefficient.
Figure 5:
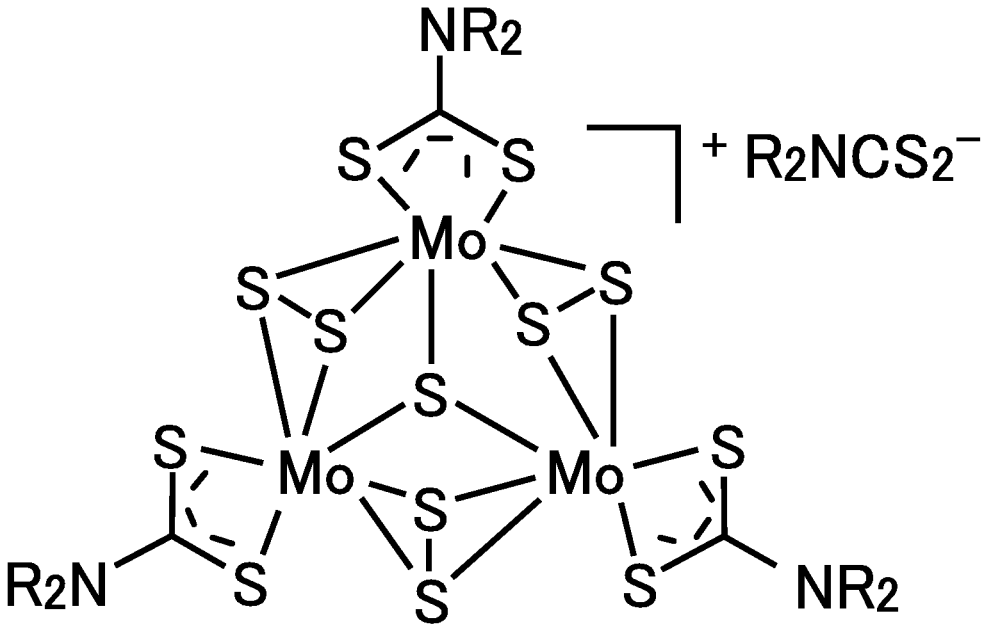
FIG. 5 is a molecular structure diagram illustrating an example of Mo-trinuclear.

Sliding surfaces of the test pieces of Samples 4-6 were analyzed using time-of-flight secondary ion mass spectrometry (TOF-SIMS/a TOF-SIMS apparatus available from Ion-Tof) after the friction test. At that time, high resolution spectrum measurement was performed for a region of 100 μm×100 μm using a $Bi^+$ beam of 30 keV as the primary ions. Mo/Cr peak intensity ratios and Ca/Cr peak intensity ratios were calculated on the basis of the obtained results. Relationships between these peak intensity ratios and the friction coefficients of respective samples are illustrated in FIG. 4A and FIG. 4B (these figures will be collectively referred to as "FIG. 4" in a simple term).

«Evaluation»

(1) Friction Coefficient

As apparent from Table 1 and FIG. 2, under the Mo-trinuclear-containing oil, the friction coefficient of Sample C0, in which the sliding surface is not coated with a Cr plating film, is higher than 0.1 while the friction coefficient of each of Samples 1-6, in which the sliding surfaces are coated with Cr plating films, is specifically lower than that of Sample C0. In particular, the friction coefficient of each of Samples 3-6 is lower than 0.04. It has thus been found that the Cr plating film selectively develops considerably low friction properties.

Figure 2B:
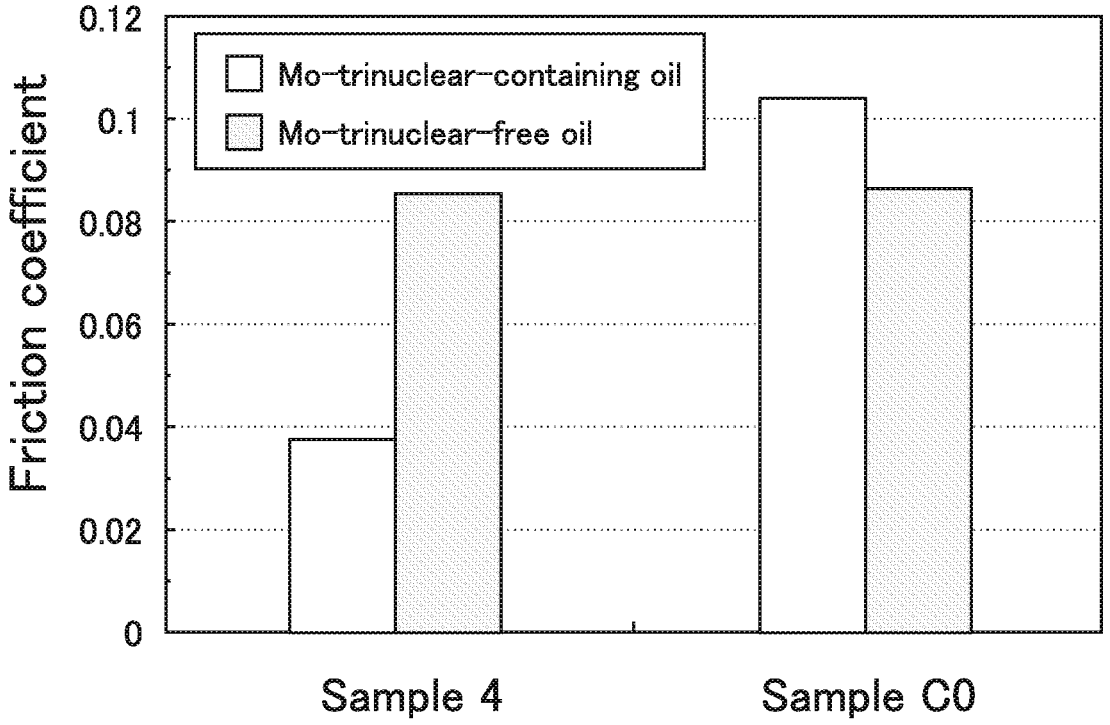
FIG. 2B is a bar graph for comparing changes of friction coefficients due to presence or absence of Mo-trinuclear in the lubricant oil.

As apparent from FIG. 2B, under the Mo-trinuclear-free oil, the friction coefficient of Sample C0, in which the sliding surface is not coated with a Cr plating film, is comparable with that of Sample 4, in which the sliding surface is coated with the Cr plating film.

It has also been found that, under the Mo-trinuclear-containing oil, the friction coefficient of Sample 4 is considerably reduced even though the friction coefficient of Sample C0 increases. In other words, it has been revealed that Sample C0 and Sample 4 exhibit opposite sliding properties under the Mo-trinuclear-containing oil.

(2) Crystal Structure of Cr Plating Film

Figure 3A:
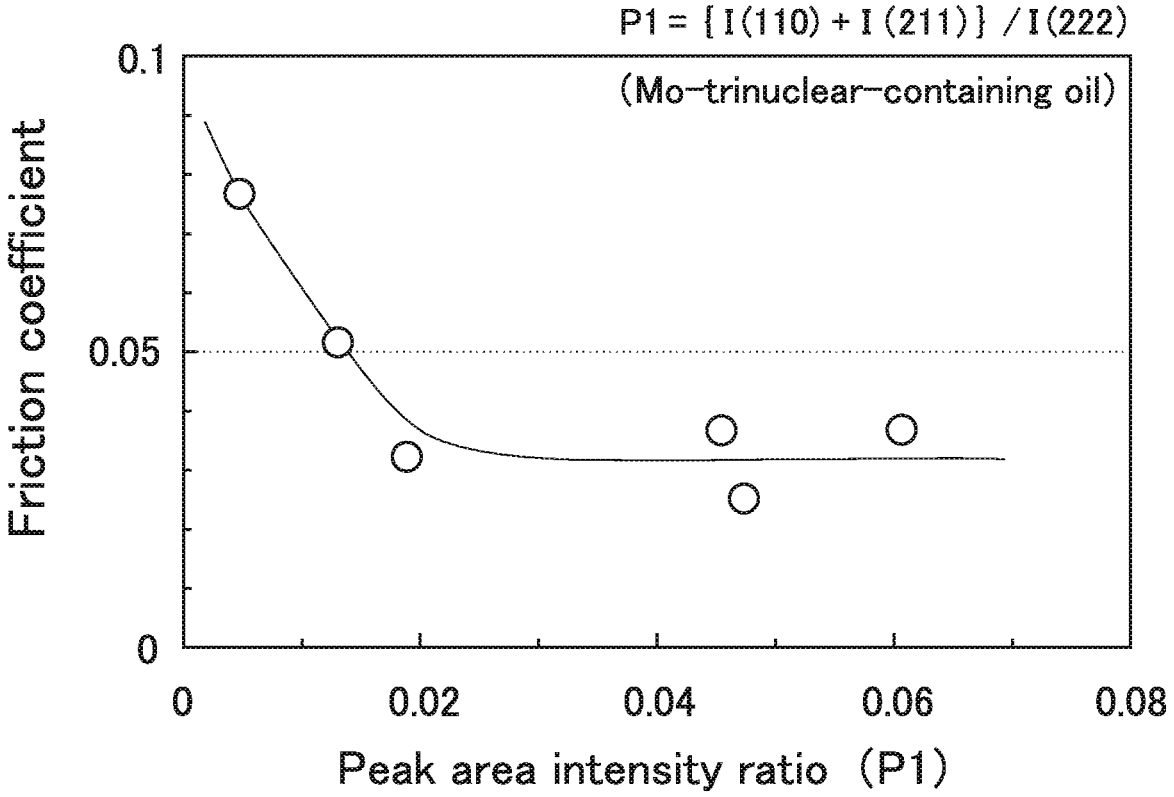
FIG. 3A is a graph illustrating the relationship between a first peak area intensity ratio (P1) and the friction coefficient of the Cr plating films.
Figure 3B:
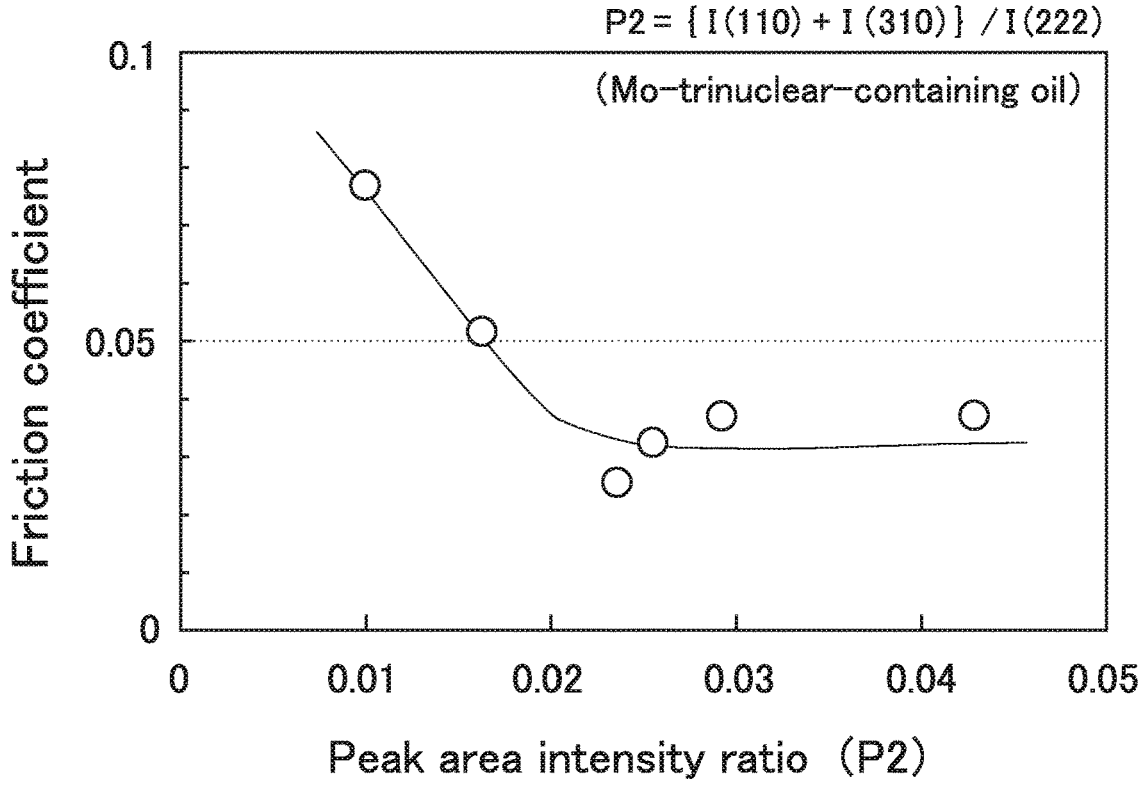
FIG. 3B is a graph illustrating the relationship between a second peak area intensity ratio (P2) and the friction coefficient of the Cr plating films.
Figure 3C:
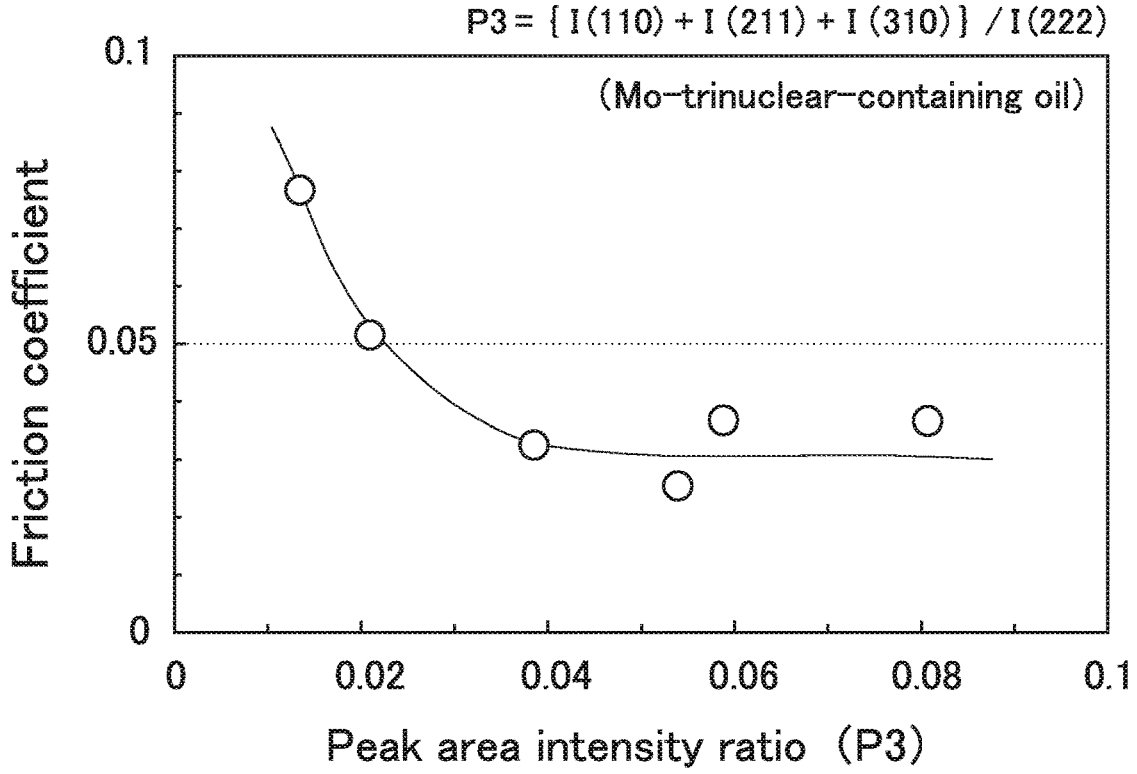
FIG. 3C is a graph illustrating the relationship between a third peak area intensity ratio (P3) and the friction coefficient of the Cr plating films.

As apparent from the XRD profiles illustrated in FIG. 1, the Cr plating films of Samples 1-6 are all crystalline. However, as listed in Table 1 and illustrated in FIG. 3A to FIG. 3C (these figures will be collectively referred to as "FIG. 3" in a simple term), the area ratios of Cr plating films of the samples are different.

As apparent from FIG. 3, in all of the Cr plating films of Samples 3-6 which develop low friction under the Mo-trinuclear-containing oil, the area ratios P1 to P3 fall within the ranges as defined by the present invention.

«Consideration»

The reason that the combination of the specific Cr plating film and the Mo-trinuclear-containing oil can develop low friction is estimated as below.

As found from Table 1 and FIG. 3, it can be considered that the interaction between the crystal structure of the Cr plating film, in particular, its crystalline orientation property and the Mo-trinuclear develops the considerably low friction properties.

As found from FIG. 4A, it is found that the friction coefficient decreases as the Mo/Cr peak intensity ratio increases. From this fact, it can be estimated that, originating from the Mo-trinuclear, a layered structural body (boundary film) similar to $MoS_2$ and the like is generated on the sliding surface and its excellent low shear property allows the development of the considerably low friction.

As found from FIG. 4B, it is found that the friction coefficient increases as the Ca/Cr peak intensity ratio increases. In other words, Ca is considered to interfere with the reduced friction of the sliding surface comprising the Cr plating film. From this, it can be considered that the Cr plating film according to the present invention preferentially adsorbs or react with Mo rather than Ca under the Mo-trinuclear-containing oil to develop the low friction. Ca is considered to be a component originated from a cleaning agent, which is generally added to engine oil.

TABLE 1

| Sample No. | Sliding surface | Peak area intensity ratio by XRD P1 | P2 | P3 | Friction coefficient Containing Mo-trinuclear | Free from Mo-trinuclear |
|---|---|---|---|---|---|---|
| 1 | Cr | 0.005 | 0.001 | 0.013 | 0.077 | — |
| 2 | Plating | 0.013 | 0.016 | 0.021 | 0.052 | — |
| 3 | film | 0.045 | 0.029 | 0.059 | 0.037 | — |
| 4 | | 0.060 | 0.043 | 0.081 | 0.037 | 0.085 |
| 5 | | 0.019 | 0.025 | 0.038 | 0.033 | — |
| 6 | | 0.047 | 0.024 | 0.054 | 0.026 | — |
| C0 | SCM420 carburized material | — | — | — | 0.104 | 0.086 |

P1 = {I(110) + I(211)}/I(222)
P2 = {I(110) + I(310)}/I(222)
P3 = {I(110) + I(211) + I(310)}/I(222)

The invention claimed is:

1. A sliding system comprising:

a pair of sliding members having sliding surfaces that can relatively move while facing each other; and a lubricant oil interposed between the sliding surfaces facing each other, wherein the lubricant oil comprises an oil-soluble molybdenum compound that has a trinuclear Mo chemical structure, wherein at least one of the sliding surfaces comprises a coating surface of a crystalline chromium plating film, wherein a peak area I(hkl) of a crystal plane (hkl) of the chromium plating film as obtained by X-ray diffraction using an X-ray of Cu-Kα and 2θ of 30°-150° satisfies at least one of expressions below:

$$P1=\{I(110)+I(211)\}/I(222)\geq 0.015;$$

$$P2=\{I(110)+I(310)\}/I(222)\geq 0.02; \text{ and}$$

$$P3=\{I(110)+I(211)+I(310)\}/I(222)\geq 0.03.$$

2. The sliding system as recited in claim 1, wherein the oil- soluble molybdenum compound includes a molecular structural skeleton comprised of at least one of $Mo_3S_7$ or $Mo_3S_8$.

3. The sliding system as recited in claim 1, wherein the lubricant oil contains the oil-soluble molybdenum compound with a mass ratio of Mo of 25-900 ppm with respect to the lubricant oil as a whole.

* * * * *